US008061377B2

(12) United States Patent
Vestergaard Frandsen

(10) Patent No.: US 8,061,377 B2
(45) Date of Patent: Nov. 22, 2011

(54) INSECTICIDAL BARRIER WITH A DURABLE LOWER PART

(75) Inventor: Mikkel Vestergaard Frandsen, Lausanne (CH)

(73) Assignee: Vestergaard Frandsen SA, Lausanne (CH)

( * ) Notice: Subject to any disclaimer, the term of this patent is extended or adjusted under 35 U.S.C. 154(b) by 0 days.

(21) Appl. No.: 12/452,377

(22) PCT Filed: Jun. 29, 2007

(86) PCT No.: PCT/DK2007/000321

§ 371 (c)(1),
(2), (4) Date: Feb. 4, 2010

(87) PCT Pub. No.: WO2009/003470

PCT Pub. Date: Jan. 8, 2009

(65) Prior Publication Data

US 2010/0132752 A1 Jun. 3, 2010

(51) Int. Cl.
*E04H 15/54* (2006.01)

(52) U.S. Cl. ..... 135/115; 135/913

(58) Field of Classification Search ..... 135/115, 135/913; 442/45, 61, 125, 123; 5/414
See application file for complete search history.

(56) References Cited

U.S. PATENT DOCUMENTS 3,323,530 A * 6/1967 Smith ..... 135/157
3,477,453 A * 11/1969 D'Ulisse et al. ..... 135/95
4,639,393 A * 1/1987 Von Kohorn et al. ..... 428/304.4
4,743,448 A * 5/1988 Bahadir et al. ..... 424/405
4,825,578 A * 5/1989 Robinson ..... 43/1
5,198,287 A * 3/1993 Samson et al. ..... 442/79
5,252,387 A * 10/1993 Samson et al. ..... 442/67
5,503,918 A * 4/1996 Samson et al. ..... 442/123
5,571,247 A * 11/1996 Butler ..... 135/87
5,631,072 A * 5/1997 Samson et al. ..... 442/125
5,664,595 A * 9/1997 Vonderhorst et al. ..... 135/16
6,009,891 A * 1/2000 Surface et al. ..... 135/98
6,145,141 A * 11/2000 Whittington et al. ..... 5/414
6,263,894 B1 * 7/2001 LaMantia ..... 135/96
6,672,322 B1 * 1/2004 Littlefield ..... 135/90
6,698,440 B2 * 3/2004 Beyer et al. ..... 135/25.41
6,701,948 B2 * 3/2004 Jopp et al. ..... 135/97
6,715,168 B2 * 4/2004 Williams ..... 5/414

(Continued)

FOREIGN PATENT DOCUMENTS

AU 42503/78 6/1979

(Continued)

OTHER PUBLICATIONS

Anon.; *Cabela's Deluxe Mosquito Bar*; Internet Web page from www.cabelas.com; accessed on Apr. 23, 2007; 1 Page.

(Continued)

*Primary Examiner* — Noah Chandler Hawk
(74) *Attorney, Agent, or Firm* — James Creighton Wray

(57) ABSTRACT

An insecticidal barrier (1) having an upper net part (2) with a mesh size preventing insects, for example mosquitoes, to transverse the barrier, the upper net part (2) having a first content of insecticide. In addition, the insecticidal barrier (1) has a lower part (3) with an insecticidal fabric, tarpaulin, foil, woven or knitted fabrics or non-woven, or net with a net material having a higher tear strength than the net of the upper part (2) in order to make the lower part (3) of the net more durable.

29 Claims, 7 Drawing Sheets

U.S. PATENT DOCUMENTS

Figure 1A:
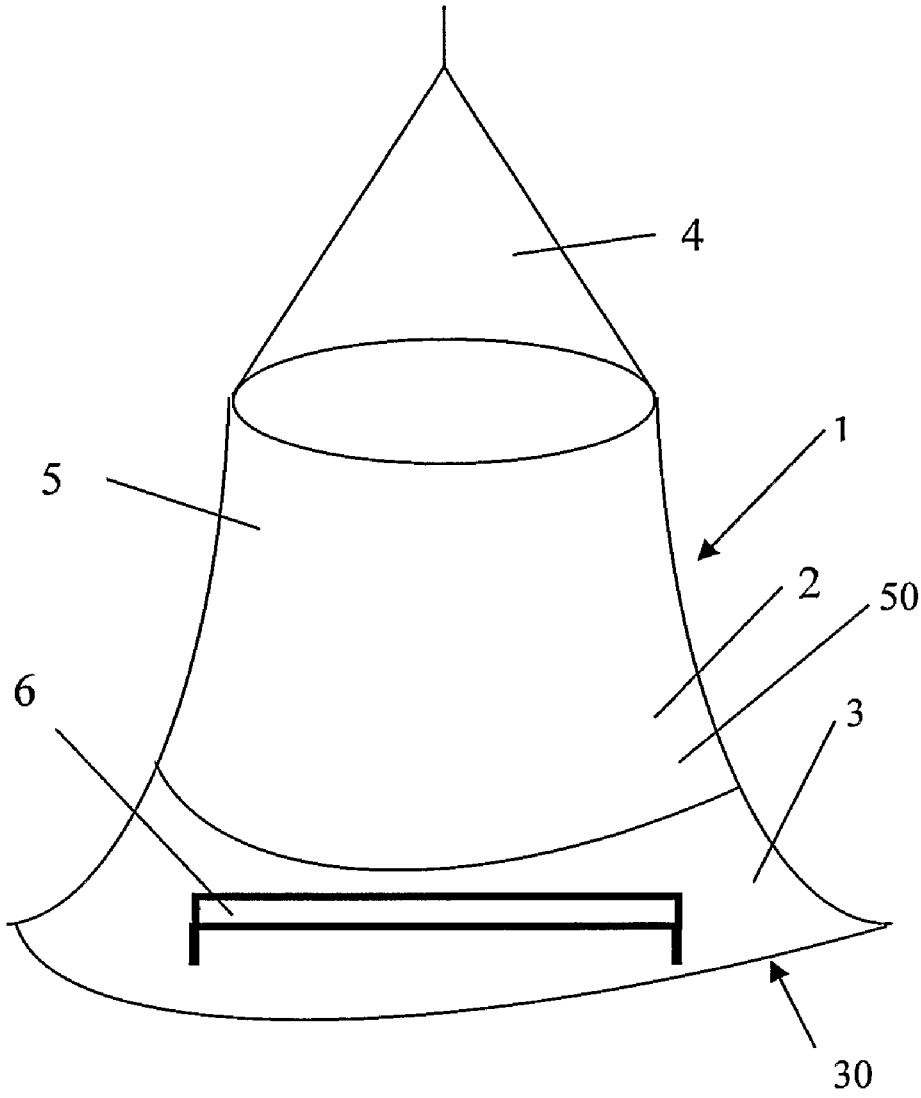

| | | | | |
|---|---|---|---|---|
| 6,896,892 | B2 * | 5/2005 | Mount et al. | 424/411 |
| 2002/0134416 | A1 * | 9/2002 | Feldpausch et al. | 135/128 |

FOREIGN PATENT DOCUMENTS

| | | | |
|---|---|---|---|
| CN | 2323677 | Y | 6/1999 |
| CN | 2452385 | Y | 10/2001 |
| CN | 2623105 | Y | 7/2004 |
| CN | 2770493 | Y | 4/2006 |
| CN | 2817625 | Y | 9/2006 |
| DE | 202004002675 | U1 | 4/2004 |
| JP | 07255571 | A | 10/1995 |
| JP | 2006/326234 | | 12/2006 |
| WO | WO 01/37662 | * | 5/2001 |
| WO | 2006117741 | A | 11/2006 |
| WO | WO 2006117741 | A1 * | 11/2006 |
| WO | WO2010046348 | * | 4/2010 |

OTHER PUBLICATIONS

Anon.; *Mosquito Nets*; Internet Web page from koimex.en.ec21.com: accessed on Apr. 23, 2007; 1 Page.

Anon.; *Mosquito Nets* (*Various*); Internet Web page from www.masta-travel-health.com; accessed on Apr. 23, 2007; 2 pages.

* cited by examiner

INSECTICIDAL BARRIER WITH A DURABLE LOWER PART

This application claims the benefit of PCT/DK2007/000321 filed Jun. 29, 2007 and the amended sheets from the IPER, which are hereby incorporated by reference in their entirety.

FIELD OF THE INVENTION

The present invention relates to insecticidal barriers, especially mosquito nets.

BACKGROUND OF THE INVENTION

Use of mosquito nets is one of the most important means for protection against vector born diseases. Accordingly, there is an ongoing effort for improving the efficiency and durability of nets, especially of nets to be used in rural areas, where supply of new nets is limited and there is a tendency to use acquired nets for a long time.

One means to improve the durability of nets is a border or skirt at the lower edge of the nets protecting the nets against wear. Such border is made of a stronger material, for example a fabric. The height of the border, typically, varies between 10 cm and 25 cm. In addition, the WHO has adopted the requirement that a Long Lasting Insecticidal Net should last for at least 20 washes and still show sufficient insecticidal activity. However, as has turned out, often, not the wash resistance is the limiting factor but the general long term use of the nets, where the insecticidal effect is reduced with time. Thus, there is a general need for improvement in the art.

Often such improvements are performed in countries other than the countries where the nets are used. For the developer, this is a challenging task, because the way of living in the countries of the developers may be substantially different from the way of living in the countries, where the nets, finally, are used. Often, this implies that the product is not optimised for the customers, and only close study of the behaviour of the customers can reveal the required optimal aspects of a product. In connection with the invention, as explained in the following, such close, behavioural studies have been performed in order to improve insecticidal products, primarily mosquito nets.

DESCRIPTION/SUMMARY OF THE INVENTION

It is therefore the object of the invention to provide an insecticidal barrier in the form of a mosquito net with improved durability.

This purpose is achieved with an insecticidal barrier that has an upper insecticidal net part with a mesh size preventing selected insects, for example mosquitoes, to transverse the barrier and a lower part extending up to a height of more than 40 cm from the lower edge of the barrier, the lower part comprising an insecticidal fabric, an insecticidal tarpaulin, an insecticidal foil, an insecticidal net with a net material having a higher tear strength than the net of the upper part, an insecticidal net with a net material having a higher mesh density or yarn density than the net of the upper part, or a combination of these. The insecticidal fabric is to be understood on a general level and implies woven or knitted fabrics or non-woven.

By providing an insecticidal barrier with a lower part made of fabric, tarpaulin, foil, or non-woven, the barrier has a higher strength of the lower part and a longer durability of the insecticidal effect than mosquito nets according to prior art. The reason for the longer insecticidal durability is not straightforward and has only been discovered by close study of the behaviour of typical users of mosquito nets, which will be elucidated in more detail in the following.

When mosquito nets are used, for example in tropical countries, especially the lower part of the net is exposed to dirt from the ground, for example dust. Typically, such dirt is brushed or tapped out of the net by the user. This brushing or tapping increases the mechanical abrasion of the insecticide in the lower part of the net such that the lower part of the net has a lower content of insecticide that the upper part of the net.

By providing a fabric, a tarpaulin, a foil at the lower part, firstly, the relatively high tightness of the material reduces the accumulation of dirt on the lower part in contrast to nets, where dirt easily accumulates in the meshes.

Often the lower part of a canopy net is primarily exposed to dirt from the outside of the net. Due to the relatively large meshes, this is also visible from the area covered by the net. In comparison, if a fabric, foil or tarpaulin is exposed to dirt and dust in the same way, this will settle on the outer side of the barrier and not on the inner side and appears less apparent and disturbing for the user inside a canopy net. This reduced appearance reduces the brushing and tapping of the net and reduced the insecticidal abrasion.

Furthermore, the insecticidal abrasion from a fabric, foil or tarpaulin is reduced as compared to a net due to the smooth surface. Also, a fabric has a reduced abrasion, as fibres are not all lying in the same plane and abrasion of the outermost fibres leaves innermost fibres with largely unreduced insecticidal effect.

Insecticidal nets are, typically, provided in standard materials having certain tear strength. Changing the tear strength and bursting strength of the entire net on demand is not possible, if the price for the net is to be kept low. However, changing the lower part of the net is within the capability for cheap production, as nets with skirts are provided already and are part of standard production techniques. By providing a lower part with a fabric, a tarpaulin, a foil, or a net material having higher tear strength and/or bursting strength than the net of the upper part, the risk for tears in the barrier is reduced. The advantage of this is obvious when pointing out that tears in prior art insecticidal nettings results in mosquitoes and other biting insects to enter the area under the net with a reduced insecticidal efficiency of the net. Even if the mosquitoes are achieving insecticide from the net, there is still enough time for the mosquitoes to bite before dying.

Not only dust and dirt from the ground is an annoyance for the user. Also, the touching of the net—which is most pronounced for the lower part of the net—leads to increased smearing of the net. The traditional expectation by the developers in the field has been that the entire net is washed, which will reduce the overall insecticidal effect of the net. However, this is not so. Typically, only those parts of the net are washed, which are subjected to dirt. Not only results the washing of the lower part in a reduction of the insecticide due to dissolution in the water, but also extensive rubbing of the net—which is only used in areas where there are no washing machines—results in extensive abrasion of the insecticide from the surface. However, as this scrubbing is performed mostly for the lower part, this part looses more insecticide than the upper part, due to the combination of dissolution by the water and the abrasion due to the scrubbing.

By providing a fabric, a tarpaulin or a foil at the lower part, sand flies are prevented from hopping into the area underneath the barrier. Sand flies are generally dangerous, as their bite can cause Leishmaniasis. In prior art mosquito nets, sand flies are not prevented from entering the nets, as they can enter through the meshes of the nets. However, as sand flies do not hop very high, the invention has the advantage of preventing sand flies bites as well.

Apart from the longer insecticidal efficiency, it has been discovered that another advantageous effect is achieved. In many of those countries, where mosquito nets are used, a rather large number of persons live in the same room, for example a tent. By providing the lower part as a fabric, foil or tarpaulin, the lower part of the barrier is opaque and gives a higher privacy for the people behind the barrier. It should be stressed in this respect, that in many of the countries where mosquito nets are used, the users are Muslim and prefer a special high degree of privacy around their sleeping and dressing area.

The term fabric also covers Dumuria fabrics, being special texturised woven fabrics. Commercially, these are available under the trademark PermaNet® Dumuria.

Thus, the invention solves a variety of technical problems based on the behavioural pattern of users of mosquito nets, which has not hitherto attracted the attention that it deserves.

Users going into the area under a mosquito net and going out again from there, also induces abrasion of the insecticide from the surface of the fibres of the net. Closer, non-published studies have revealed that it is especially the region up to around 75 cm from the lower edge of the barrier that has reduced insecticidal activity. This is also surprising, because one would expect the net to be exposed to wear up to a height corresponding to the height of a person entering and exiting a canopy net. Even a person bending down in order to enter a canopy net would, still, have a height of more than 75 cm. However, having regards to this particular study, in a further embodiment of the invention, the height of the lower part extends to at least 60 cm from the lower edge and preferably up to 80 cm or 100 cm.

In order to take further account into the partial washing and brushing of the lower part of the net, in a further embodiment, the lower part of the barrier has a higher content of insecticide than the upper part in order to compensate for the increased brushing, tapping and/or washing.

The barrier according to the invention need not have a higher insecticidal content during the entire lifetime of the barrier, it is sufficient that it has a higher insecticidal content during an initial phase being a substantial part of the lifetime of the barrier. The insecticidal content may gradually decrease in line with the insecticidal content of the upper part. Due to the higher content in the lower part of the barrier, there is a potential for sufficient insecticidal activity of the lower part of the barrier despite increased abrasion of insecticide relative to the upper part.

As a conclusion, the invention takes into account a number of observations from different points of view to find a solution which improves insecticidal barriers, preferably mosquito nets, which are used for a long time. Because the lower part has a higher content of insecticide, abrasion of the insecticide from the surface of the net is balanced by the higher content of the insecticide.

For a netting, a higher content of insecticide can be achieved by providing a lower part of the netting with higher mesh density and/or yarn density and/or weight density. A net with a higher mesh density can also be achieved in a single production process, where the weave process is different for the lower part, for example by including additional threads. The higher yarn density implies a higher insecticidal content if the containment of the yarns is identical.

If the lower part contains a second insecticide being different from a first insecticide of the upper part, this part shall maintain the lifetime as long as the upper part by balancing the dosage and the wash resistance.

If the lower part contains a second insecticide being different from a first insecticide of the upper part, and the second insecticide has a higher insecticidal efficiency, the content of the second insecticide need not necessarily be higher than the content of the first insecticide. The higher efficiency may be balanced by a lower content. In this case, the determining factor is the equivalent content, which is the amount of the second insecticide multiplied by the ratio between the efficiency of the second insecticide and the efficiency of the first insecticide. In the following, the term insecticidal content also covers the fact of an equivalent insecticidal content. The term efficiency in this connection is the insecticidal efficiency on the surface of the barrier, thus the efficiency when insects are in contact with the surface. Thus, the efficiency in this respect, indirectly, also includes the release rate Generally, the insecticidal barrier according to the invention can be termed mosquito net despite the fact that it also protects against other insects. I may also be called a mosquito net according to the general used terminology in the field, despite the fact that part of the material of the insecticidal barrier, namely a skirt or even the lower part of the net, need not be a net but can be a fabric or tarpaulin.

The lower part of the insecticidal barrier may extend down to the floor or down to a fabrics skirt, tarpaulin skirt or foil skirt, where the skirt extends up to a certain height, for example 10 cm or 25 cm.

Preferably, the barrier according to the invention is a canopy-like barrier of the circular or rectangular type with a roof part made of a net and side walls, where the lower part of the barrier is the lower part of the side walls. This type is usually used to cover a space around a bed or other space for human accommodation for keeping insects out of the space. For example, the barrier is a bed net.

As mentioned above, the lower part of the barrier is exposed to additional wear, why the material of the lower part of the barrier may be made of a more wear resistant material than the upper net material of the barrier. Such more resistant material may be a net as well, for example made of thicker threads, where the thicker threads in the case of multifilament threads contain thicker filaments or a higher number of filaments than the threads for the net of the upper part of the barrier.

As mentioned above, the lower part of the net may also be made of fabrics or a tarpaulin material extending down to the skirt. Alternatively, the lower part of the barrier may be an upwardly extended skirt.

The higher content of the insecticide in the lower part of the insecticidal barrier may be provided by an impregnation with higher insecticidal content. Impregnations of nettings or fabrics are disclosed in International patent application WO01/37662 by Skovmand. By choosing a higher insecticidal content in the impregnation, a film or coating protecting the insecticide may be adapted to release of insecticide at a higher relative amount to the surface of the lower part in order to end with a released dose corresponding to the requirements in the field, for example the guidelines of the WHO, even when taking abrasion of the insecticide into account.

Alternatively, the insecticide may be incorporated in the fibre material or tarpaulin material of the lower part of the insecticidal barrier for gradual migration from inside the material—preferably a polymer matrix—to the surface of the material of the fibres or tarpaulin. An example of such incorporation is disclosed in International patent application WO 03/063587 by Vestergaard Frandsen. In case of incorporation of the insecticide into the fibres, the insecticidal efficiency of the barrier is long lasting despite abrasion of the insecticide from the surface of the material, because the insecticide is replenished to the surface of the barrier due to the gradual migration from inside the material. The insecticide is protected from removal from the surface of the barrier as long as the insecticide in inside the material. In addition, incorporation of insecticide into the material of the barrier, where incorporation also may be used for the upper net part of the barrier, improves the resistance against degradation of the insecticide when exposed to sunlight or by general exposure to heat. Also in this case, account is taken for release of insecticide at a higher relative amount to the surface of the lower part in order to achieve a released dose for a long lasting effect corresponding to the requirements in the field, for example the guidelines of the WHO, even when taking abrasion of the insecticide into account.

Typically, the barrier according to the invention is made of polymer, preferably polyethylene or polyester (Polyethylene Terephthalate, PET). However, the upper part and the lower part need not be made of the same polymer. For example, the upper part may be fabricated in polyethylene, and the lower part in polyester.

The term insecticide covers one insecticide or a plurality of insecticides, where the plurality of insecticides may be a mixture but need not be so. The upper and the lower part may comprise the same insecticides, but this is not necessary. Different insecticides in the lower and the upper part of the barrier may be used as means for counteracting resistance against one of the insecticides. Typically in mosquito nets, deltamethrin is used as insecticide, because it has no substantially harmful effect on humans despite being very efficient against mosquitoes and flies.

However, there are mosquito species that have become resistant to deltamethrin. Thus, in the upper part of the barrier according to the invention, a different insecticide may be used, for example carbamates. This type of insecticide is, typically, not preferred, as it is more harmful for humans. However, the fact that wear only seems to occur up to a height of 75 cm, or 100 cm at maximum, indicates that the barrier above the lower part is not touched by humans to the same degree as the lower part. Thus, the lower part may be treated with a first insecticide which is very little harmful to humans, for example deltamethrin, whereas the upper part, possible only a roof of the barrier, is treated with an insecticide against which insecticidal resistance is very poor, and where the more harmful effect on humans is accepted as a compromise against the danger which resistant insects imply for humans.

The upper or lower part or both may comprise synergist, for example PBO. The term synergist comprises one synergist or a plurality of synergists, where the plurality of synergist may be a mixture but need not be so. The upper part may comprise a first synergist and the lower part may comprise another synergist. The term synergist also covers an analogue or precursor for a synergist. The synergist may equally well be incorporated in the material of the barrier—preferably a polymer matrix—for gradual migration of the synergist from inside the material to the surface of the material.

The upper part of the barrier is a net. For this net, a thread dimension corresponding to between 50 and 100 Denier, for example 75 Denier, is feasible, as is common practice for mosquito nets, for example as it is used for the successful mosquito net with the registered trade mark PermaNet®. In order for the lower part of the barrier to be more durable, one or more additional threads may be inserted into a net material forming the lower part of the barrier. These additional threads may contain additional insecticide of the same type or a different type and may, as a further option, have incorporated therein a synergist. As a further example, these additional threads may have incorporated therein a different insecticide or a synergist or both. Such additional threads can be used to decrease the mesh size in order to prevent smaller, low flying or hopping insects to pass the barrier. For example, such threads may have dimensions in the range 100 to 150 denier.

One possible combination is a polymer matrix of the upper or lower part or both with synergist, for example PBO, incorporated in the matrix material but without insecticides in the matrix, and with an insecticidal coating, for example containing deltamethrin, on the polymer matrix. In order for the PBO to reach the surface of the first region, the coating film is open for migration of the synergist through the film.

By incorporating the synergist in the polymer matrix with the ability to migrate to the surface of the matrix, a product is provided that leaves open a high number of choices for the final insecticidal composition with which the polymer matrix of the upper part or the lower part or both are coated.

For example, the upper part or the lower part or both may be coated with a wash resistant polymer film as disclosed in WO 01/37662. In this case, the film comprises a film forming component reducing wash off and degradation of the insecticide from the netting or fabric by forming a water and optionally oil resistant film, the film being a molecular shield on or around the matrix integrating the insecticide in the film, wherein the film forming component comprises a polymeric backbone fixative and one or more components selected from paraffin oils or waxes, silicons, silicon oils or waxes, and polyfluorocarbons, or derivatives thereof. Preferably, the film forming component comprises polyflurocarbon side chains attached to the polymeric backbone fixative. Preferably, the insecticide is migratably trapped between these polyfuorocarbon side chains and protected against water by the hydrophobic action of the polyfluorocarbon. This implies that the insecticide is protected from water or oil on the surface as long as the insecticide in within the protecting polyfuorocarbon. In this connection, it is important that the insecticide is trapped releasably between the side chains. In other words, the insecticide should have a mobility such that it can migrate out of the backbone and to the surface of the film in order for uptake by insects. The migration may be at least partly governed by a gradient of insecticide concentration, but active migration promoters or inhibitors may be applied as well in order to find the optimal migration speed, such that a sufficiently high dose of insecticide is on the outer surface of the fibre material over a prolonged period.

In addition, also a synergist, for example PBO, may correspondingly be migratably trapped between the polyfluorocarbon side chains in order to be protected against wash out and nevertheless be able to migrate gradually to the surface of the film for uptake by insects. This is advantageous in connection with the invention. However, the substitution of the insecticide by a combination of insecticide and synergist, for example deltamethrin and PBO, in a method and coating as disclosed in WO 01/37662 is of general nature and may improve prior art on a general basis.

In case that a film forming component is desired without insecticide but with synergist, for example PBO, the method as disclosed in WO 01/37662 may be used for a coating with the synergist taking the place of the insecticide in the coating. This amendment of the method in WO 01/37662 for a synergist is advantageous in not only connection with the invention but is of general nature and may improve prior art on a general basis. For example, the insecticide may be incorporated in the material which is covered by a synergist-containing film, through which the insecticide migrates to the surface of the material.

In addition, the method according to the disclosure of WO 01/37662 with insecticide may be improved if i) the insecticide is dissolved in a solvent combined with alcohol or glycol, the alcohol or glycol having a water content of less than 5%, or ii) the insecticide is dissolved in a solvent and mixed with water or mixed with a water phase emulsion or solution having a temperature of less that 30° C., optionally, the solvent being combined with alcohol or glycol before the mixing, or i) combined with ii).

The improvement relative to the disclosure of WO 01/37662 is due to the fact that two aspects i) and ii) both reduce the risk for precipitation of the insecticide in the combined solution. This reduction increases the lifetime of the insecticidal activity in the film and improves the wash resistance. This is especially true for pyrethroids, where the preferred insecticide is deltamethrin or permethrin. Thus applying either the step i) or applying the step ii) is an improvement as compared to prior art, however, the best improvements are achieved by using a combination of i) and ii).

The film forming component may comprise other components such as UV protecting agents, preservatives, detergents, fillers, impact modifiers, anti-fogging agents, blowing agents, clarifiers, nucleating agents, coupling agents, conductivity-enhancing agents to prevent static electricity, stabilizers such as anti-oxidants, carbon and oxygen radical scavengers and peroxide decomposing agents and the like, flame retardants, mould release agents, optical brighteners, spreading agents, antiblocking agents, anti-migrating agents, migration promoters, foam-forming agents, anti-soiling agents, anti-fouling agents, thickeners, further biocides, wetting agents, plasticizers adhesive or anti-adhesive agents, fragrance, pigments and dyestuffs and other liquids including water or organic solvents.

Alternative insecticidal coatings applicable in connection with the invention are disclosed in WO 2006/092094 by Liu et al. concerning a net/fabric coating containing a pesticide, an aqueous adhesive, like a waterborne polyurethane latex or polyacrylate latex, and a cross linking agent, like an epoxy polymer cross linking agent. A number of different formulations—also applicable in connection with the invention—are disclosed in WO 2006/092094, which, more specifically, disclosed a finishing liquid for repelling and killing mosquito/insect, whose formulation (based on mass percent) comprises:

| | |
|---|---|
| pesticide and/or repellent, | 0.05%-40.00%; |
| adhesive | 5.00%-40.00%; |
| cross-linking agent | 0.025%-1.50%; and |

the rest is water, all the components amount up to 100%.

The pesticide in WO 2006/092094 is an aqueous pesticide with an effective content of 1-50%, and said aqueous pesticide is prepared from one or two of the following substances: deltamethrin, cyfluthrin, cyhalothrin, cis-cypermethrin, permethrin and etofenpox. The repellent in WO 2006/092094 is an aqueous repellent with an effective content of 1-50%, and said aqueous repellent is prepared from one or two of the following substances: diethyltoluamide (DEET), dimethyl phthalate and permethrin. The aqueous dosage form of said pesticide and repellent in WO 2006/092094 includes one or two of the following dosage forms: wettable powder, water dispersible powder, water dispersible suspension, water dispersible tablet, emulsion in water, microcapsule suspension, and water dispersible granule. The adhesive in WO 2006/092094 is an aqueous adhesive with a solid content of 40-50%, which contains one or two of the following substances: polybutadiene latex, waterborne polyurethane latex, polyacrylic acid latex, polyacrylate latex or vinyl acetate latex. The cross-linking agent in WO 2006/092094 contains one or two of the following substances: epoxy polymer crosslinking agent, methyl-etherified hexahydroxymethyl melamine resin primary condensate crosslinking agent, multi-functional aziridine crosslinking agent, various hydroxymethyl crosslinking agents, a crosslinking agent consisting of hydroxyethyl and epoxy groups, and an acetate crosslinking agent of polycondensate of epoxy chloropropane and hexandiamine.

Preferably, the insecticide in connection with the invention is a pyrethroid, preferably deltamethrin or permethrin, but other pyrethroids may apply as well, as disclosed as a list in WO 01/37662. However, the invention applies as well in connection with cabamates or organophosphates in the composition for impregnation. A more extensive list of possible insecticide is found in WO 01/37662 or in WO 06/128870 also containing examples of repellents.

In addition, the term insecticide applies as well to insecticide combinations in the composition for impregnation according to the invention and as described above. For example, a pyrethroid may be combined with carbamates or organophosphates in order to combat resistant insects as well. Also, two or more insecticides may be applied on various parts of the net or fabric, for example by printing or spraying techniques, and not mixed and used homogeneously, which can be beneficially with respect to toxicological and registration reasons. Where nets are used in mass campaigns, there may be incorporated an alternative or supplemental agent with a sterilising effect thus to sterilise the mosquitoes and avoid the next generation of mosquitoes. Such agents can be of the benzoyl urea group or triazins.

Further possible combinations include metaflumizone as disclosed in WO 06/127407, N-arylhydrazine as disclosed in WO06128870 or derivatives of 1-Phenyltriazole as disclosed in WO06128867, for example combined with a pyrethroid.

In addition, or alternatively, insecticides may be combined with synergists in the coating, for example piperonyl butoxide, Sulfoxide, Tropital, Bucarpolate, ethion, profenofos, or dimethoate, Piperonyl Cylonene, TPP, Di-ethyl maleate, NIA-16388 (NIA), S-421, MGK-264 (bicycloheptenedicarboximide), S,S,S-tributyl phosphorotrithoate (DEF), —N-Octylbicycloheptene dicarboxaminde, Sesamin, Sesamolin, or Sesamex.

A further alternative for a coating in connection with the invention is disclosed in US2007009563, wherein formula of solution according to various embodiments of the present invention comprises 4 portions as follows: 1. Insecticide from pyrethroid group such as deltamethrin, esfenvalerate, ethofenprox, biphenthrin, permethrin, and cyhalothrin which are quickly active and have a high boiling point. 2. A thread stabilizing enhancer, for example, a compound of perfluoro acrylate, resin, adhesive, and polyacrylate. 3. Thickeners such as starch, gum, and titanium dioxide. 4. Solvents, for example, water.

As a further alternative, the upper part or the lower part of the barrier or both may be provided with a first insecticide incorporated or impregnated into the polymer matrix and with an insecticidal film in addition. The insecticide or insecticides in the matrix may be different from the insecticide in the film, which can be used as a further measure to counteract resistance to one of the insecticides. In order to provide a higher content of insecticides and/or a more durable insecticidal efficiency in the lower part of the barrier, the lower part may have insecticide incorporated in the material but not the upper part. For example, the lower part may be provided with a polymer matrix into which insecticide, and optionally synergist, is incorporated, after which the entire barrier is impregnated with insecticide, for example in the form of a protecting coating or film. The incorporated insecticide may then replenish the insecticide to the surface of the lower part, in case that the insecticide from the film is not sufficient to counteract the decreased efficiency due to abrasion.

In the case of migration of synergist and/or insecticide in the material of the upper or lower part or both, it is important to take into account the migration speed of the synergist and/or insecticide in the matrix and the migration speed of the further synergists or insecticides. For example, this may be regulated by a proper choice of selectively working migration promoters and migration inhibitors.

In a practical embodiment, the polymer matrix of fibres in the insecticidal barrier is formed by extrusion of molten thermoplastic polymer through an extrusion nozzle. This method may provide fibres for nets as well as fabrics. The fibres may contain extruded monofilaments or multifilament or both. For example, a mixture of multi-filaments and monofilaments can be achieved by plying techniques. Synergist or insecticide or both is added to the molten polymer through a channel in or upstream of the extrusion nozzle. This may in certain combinations be critical, especially, if the matrix is made of polyester (Polyethylene Terephthalate, PET), which is a preferred material for fabrics and nettings. This is so, because the melting temperature of polyester is around 250° C., which may lead to disintegration of synergist or insecticidal material.

However, the degree of decomposition and physical loss of the synergistic or insecticidal agent is not only dependent on the temperature but also dependent on the time for which the agent is exposed to the high temperature. By minimizing the contact time of agent with high temperature, the loss is reduced significantly. Loss here includes evaporation and possible thermal decomposition.

Thus, in order to minimize the exposure time for the high temperature, a special principle of an extrusion nozzle has been invented. This principle is a nozzle with a channel through which an agent containing the synergist or insecticide or both is added into the molten polymer during the extrusion process, wherein the channel is provided at a short distance upstream of the nozzle exit. In this context, the term "short distance" is to be understood as a distance that results in a temperature increase in the synergist or insecticide and a time lapse at this temperature which leaves a still sufficient amount of intact synergist or insecticide in the extruded matrix. For example, the distance may be chosen to yields a maximum temperature increase in the synergist or insecticide and a maximum time of exposure of the synergist or insecticide to this temperature increase, wherein the maximum temperature and the maximum time are limited by predefined upper levels.

How much this "sufficient amount" is, depends on the synergist and/or insecticide and the acceptable level of loss. In certain cases, a loss of 99% can be acceptable, if the 1% remaining synergist and/or insecticide is still within the range of effective amounts to counteract insecticidal resistance for a long term. In other cases, a loss rate of less than 90% may be acceptable. Thus, the invention provides a method for incorporating synergists and/or insecticide in thermoplastic polymers, despite the fact that the melting temperature of the polymer is far above the boiling temperature of the synergist and/or the decomposition temperature of the insecticide. In experiments, it has surprisingly turned out that for polyester, more than 50% of the synergist stays intact despite an extrusion temperature of more than 250° C.

In a preferred embodiment, the channel is provided in the side of an extrusion, for example within a few mm or cm from the nozzle exit. This implies that the agent with the synergist and/or insecticide is first subjected to the temperature of the polymer when it enters the nozzle. For example, the nozzle may be surrounded by a ring-formed agent supply conduit injecting the agent into the molten polymer substantially over the entire rim of the polymer stream through the nozzle.

This leaves also the possibility of cooling the agent before injection, such that the temperature increase of the agent due to the uptake of heat from the polymer accelerates the hardening and cooling of the polymer. In addition, the extruded polymer may be actively cooled at a short distance downstream of the extrusion nozzle, for example by a cold air jet.

Despite the above possibility to incorporate synergists and/or insecticides in polyester, the much lower melting temperature of polyethylene makes incorporation of synergists and/or insecticides into a polymer matrix much easier. Thus, in order to utilize this fact, the barrier according to the invention may be provided by multiple polymers, for example, with a first polymer for the upper part and a second, different polymer for the lower part.

The upper and the lower part may—as described above—be fabricated in one process by changing the weave or knitting during the production. However, the upper and the lower part may also be combined in different ways, for example by gluing, melting or sewing different parts together.

Also other agents, for example insect sterilising agents or agents with entomopathogens, may be applied in the combat against insects in connection with the invention. For example, these may be applied to the surface of the barrier. An example of fungal biopesticide for insect combat is described by Thomas and Read in Nature Reviews Microbiology, Vol. 5, May 2007, p. 377. Though at present, especially fungal endomopathogens seem the most useful, an insect infecting virus, bacteria or protozoa may be applied, alternatively or in addition.

By using printing techniques, not only insecticides and synergists can be applied to those regions, where it is desired, but also the above mentioned entomopathogens and/or insect sterilising agents. By using spraying or printing techniques, small spots or large areas may be provided with a precise positioning and precise dosing. Furthermore, different agents may be placed not only side by side but may be applied on top of each other with migration of the different agents through the covering layers.

SHORT DESCRIPTION OF THE DRAWINGS

Figure 1B:
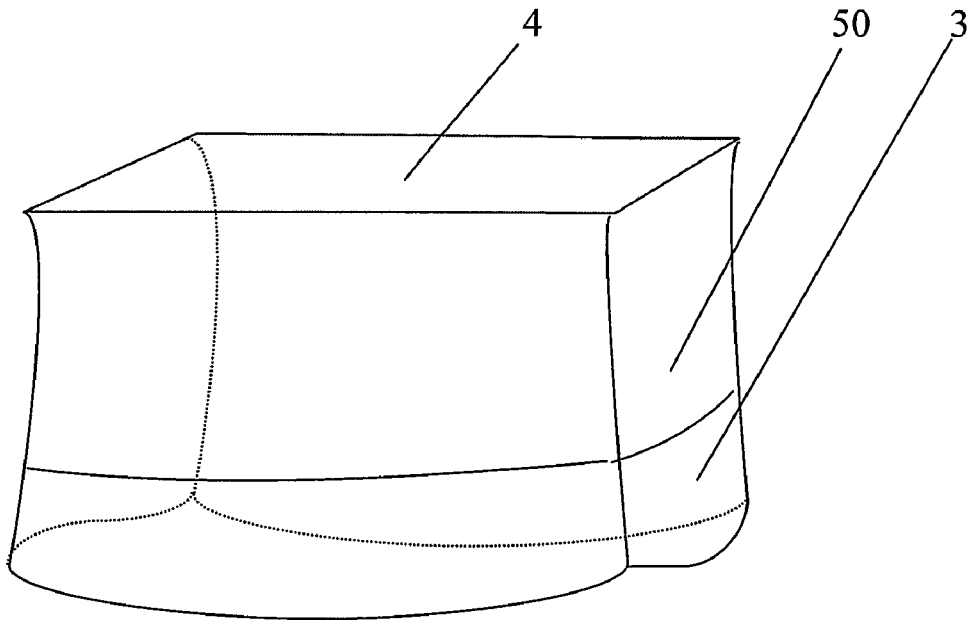
Figure 2:
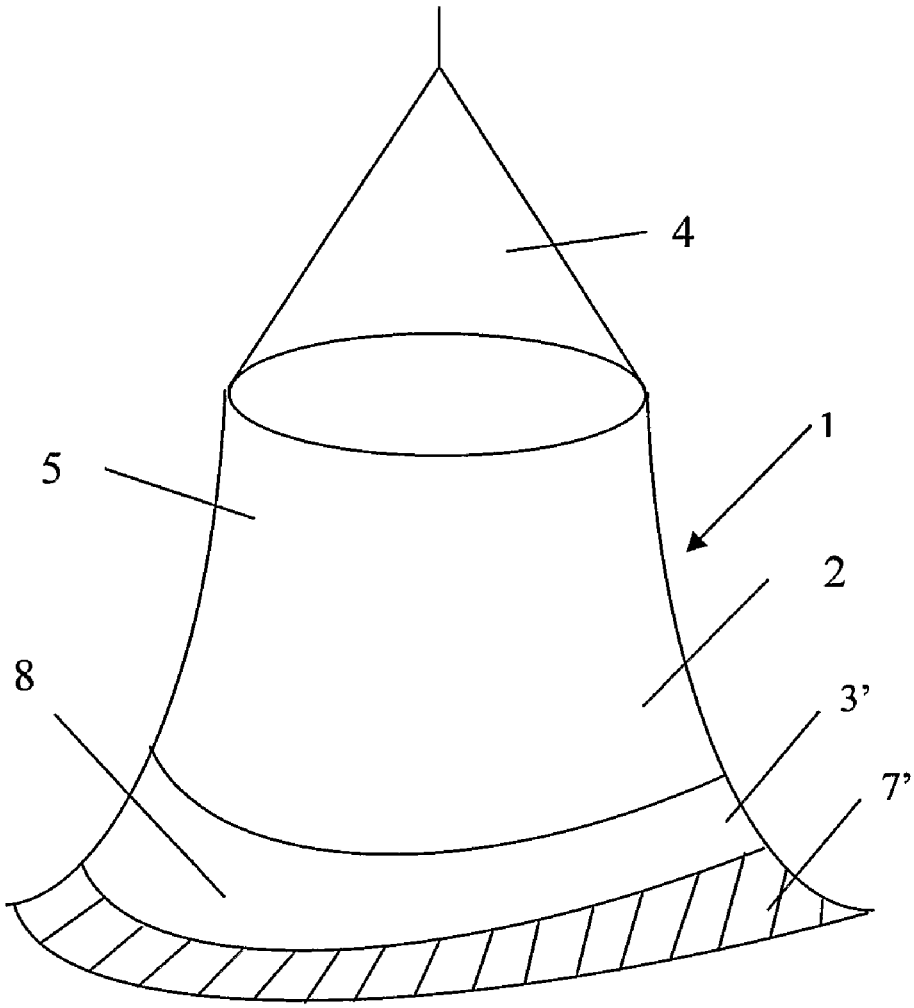
Figure 3:
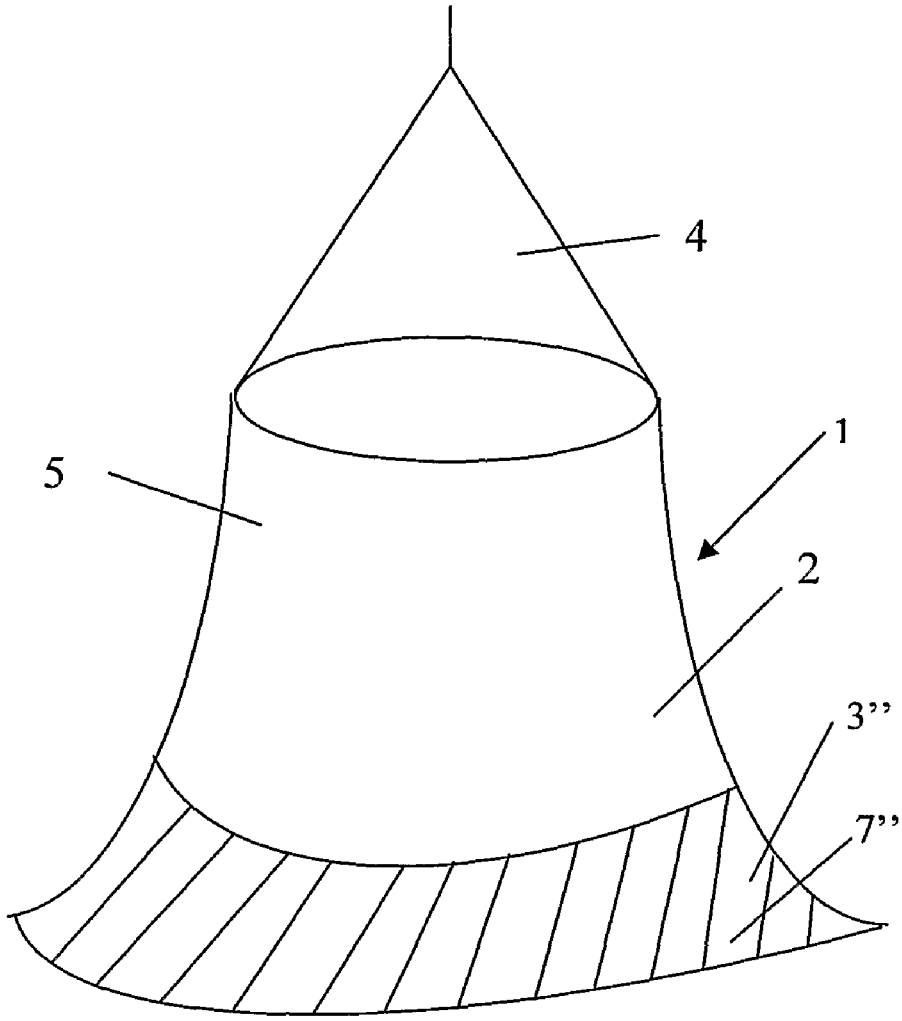
Figure 4:
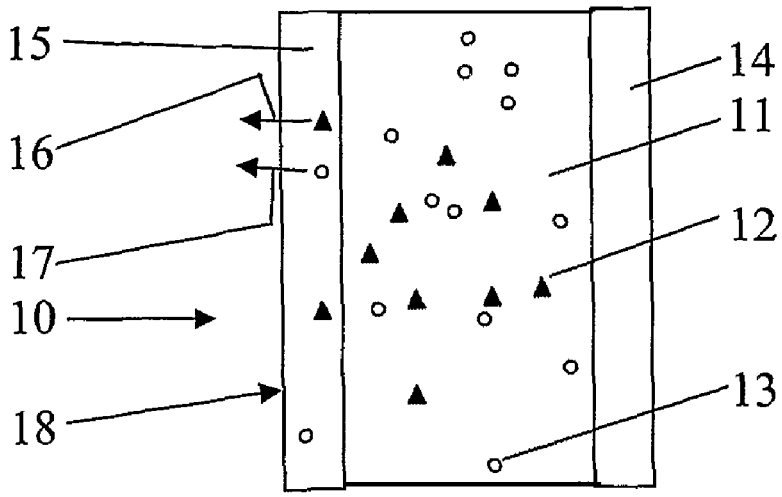
Figure 5:
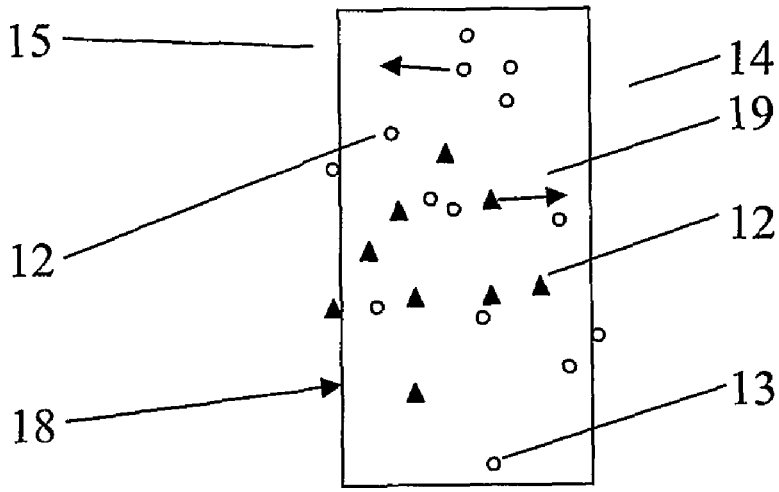
Figure 6:
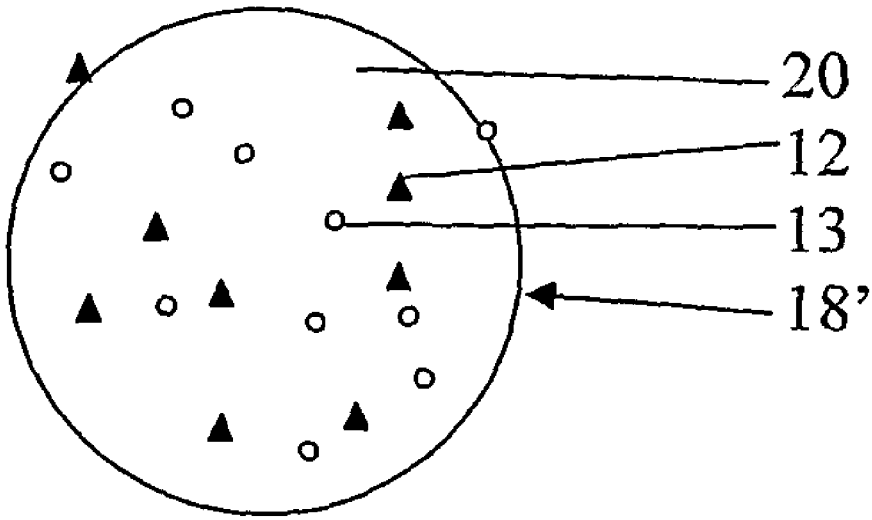
Figure 7:
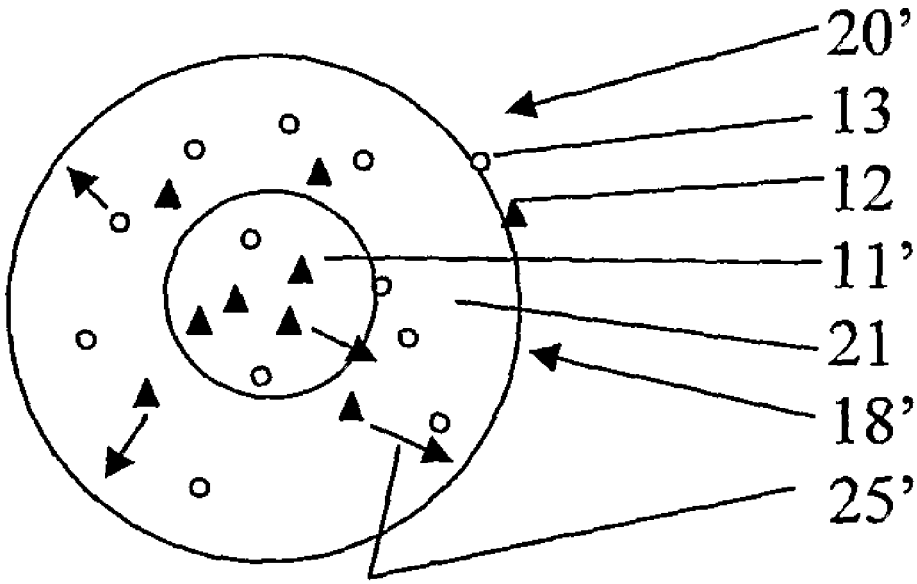
Figure 8:
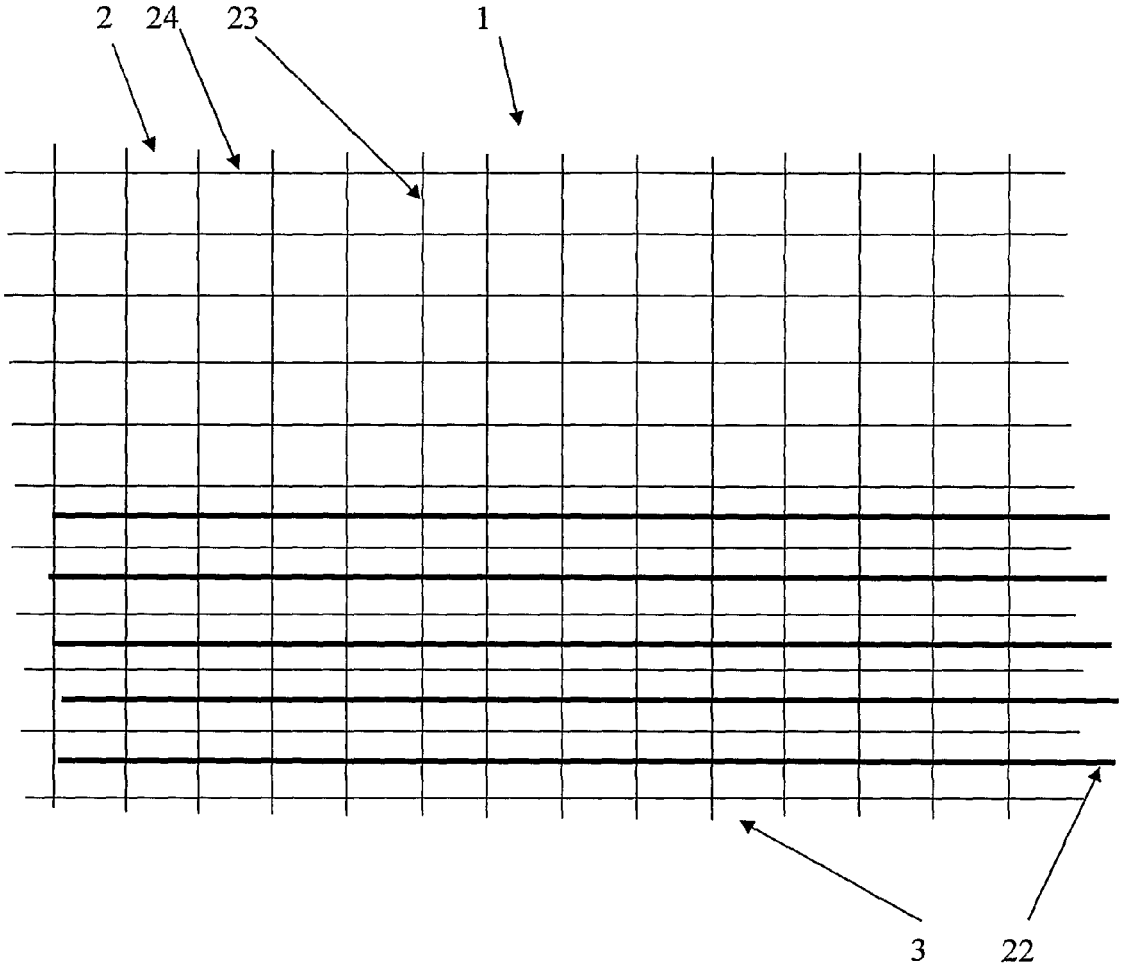

The invention will be explained in more detail with reference to the drawing, where FIG. 1 illustrates a canopy net with an upper part and a lower part, FIG. 2 illustrates a canopy net wherein the lower part comprises a skirt, FIG. 3 illustrates a canopy net with a skirt constituting the lower part, FIG. 4 illustrates a tarpaulin material with a reservoir, FIG. 5 illustrates a tarpaulin material with incorporated synergist and/or insecticide, FIG. 6 illustrates a fibre with a reservoir, FIG. 7 illustrates a fibre with incorporated synergist and/or insecticide, FIG. 8 illustrates a net with higher yarn density in the lower part of the net.

DETAILED DESCRIPTION/PREFERRED EMBODIMENT

FIG. 1*a* illustrates a circular canopy insecticidal barrier according to the invention, and FIG. 1*b* illustrates a rectangular canopy. The barrier 1 has a roof 4 and side walls 5 extending to the lower edge 30 of the barrier, wherein the upper part 2 of the barrier includes the roof 4 and the upper part 50 of the side walls 5, wherein the lower part 3 of the barrier 1 is the lower part of the side walls 5. The canopy insecticidal barrier is intended to cover a space for human beings or animals, for example a bed 6 as illustrated in FIG. 1*a*. In order to enter the space underneath the canopy, the lower part 3 of the barrier 1 is exposed to surface touch and, therefore, exposed to abrasion of insecticide from the surface of the material. The upper part 2 is a net, whereas the lower part 3 may be a net, a fabric or a tarpaulin or a combination of these.

FIG. 2 illustrates an alternative embodiment of a barrier 1' according to the invention, wherein the lower part 3 of the barrier 1' comprises a skirt 7'. Optionally, the skirt 7' may be made of a different material than the rest of the lower part 3'. For example, the lower part 3' may be a net apart from the skirt 7' being a fabric. Alternatively, the skirt 7' may be a fabric or tarpaulin, whereas the rest 8 of the lower part 3', which is an intermediate part 8 between the skirt 7' and the upper part 2, may be a different fabric or a net. The skirt 7' and the rest 8 of the lower part 3' between the skirt 7' and the upper part 2 may have different insecticidal treatments and different contents of synergist. Also, the insecticidal content and type of insecticide or synergist may be different in the lower part '3 than in the upper part 2. As illustrated in FIG. 2, the intermediate part 8 between the skirt 7' and the upper part 2 has an area, which is larger than the surface area of the skirt 7'.

FIG. 3 illustrates a further alternative embodiment of a barrier 1" according to the invention, wherein the barrier 1" comprises a skirt 7" extending upwards in height in order to constitute a lower part 3" of the barrier 1". Examples for materials of such skirts are fabrics and tarpaulins. However, a netting material of more durable configuration than the upper part 2 of the net is a further possibility.

As illustrated in FIG. 4, in case that a tarpaulin is used for the skirt 7', 7", the tarpaulin 10 may comprise a reservoir 11 of insecticide, stylistically shown as triangles 12, or synergist, stylistically shown as circles 13, or both sandwiched between two outer wall elements 14, 15. The insecticide 13 or synergist 14 or both 13, 14 are configured to migrate through at least one of the outer walls 13, 14, which is indicated by arrows 16 and 17, in order to reach the surface 18 of the tarpaulin 10.

A illustrated in FIG. 5, the tarpaulin 10 itself may be made of a polymer matrix 19 containing synergist 12 or insecticide 13 or both migratably incorporated in the polymer matrix 19.

This principle applies as well for fibres, as illustrated in FIG. 6. In this case, synergist 12 or insecticide 13 are both migratably incorporated in the polymer matrix of the fibre 20 in order to migrate to the surface 18' of the fibre 20.

As alternatives, illustrated in FIG. 7, fibres 20' are produced with a reservoir 11' and a surrounding shell 21, wherein synergist 12 or insecticide 13 or both migrate which is illustrated by arrow 25'—from the reservoir 11' through the outer shell 21 to the surface 18' of the fibre.

FIG. 8 illustrates a barrier 1 in the form of a net with first threads, in this case vertical threads 23 and horizontal threads 24. The net has an upper part 2 and a lower part 3, wherein the lower part 3 has a higher density of threads due to additional threads 22 containing additional insecticide. The insecticide in these additional threads 22 may be incorporated into the material. For example, the first threads 23, 24 may be made of the same material in the upper and the lower part of the net, preferably of polyester due to its cotton-like feeling and reduces flammability. However, as discussed above, polyester has a relatively high melting temperature and, therefore, is not so suitable for incorporation of insecticides, because these are easily damaged by the high temperature of the molten polymer when the insecticide is added to the polymer. In contrast, polythylene melts at relatively low temperature and, therefore, is more suited for incorporation of insecticide into the polymer. Consequently, it may be of advantage if the first threads 23, 24 are made of polyester and the additional threads 22 are made of polyethylene with insecticide incorporated. Optionally, also synergist in incorporated into the additional threads.

A net or fabric can be produced in a single process with part of it having a higher mesh or yarn density in order to achieve a more dense material with a higher tear strength and bursting strength.

FIG. 8 illustrates a weave with a higher mesh density, however, a knitted net or fabric may be produced in an analogue way, where additional threads are woven into the fabric or netting such that a smaller mesh size is achieved and a higher tear strength and bursting strength. As an alternative, the knitting pattern can be changed in order to obtain a different strength in the material.

The invention claimed is:

1. An insecticidal barrier having an upper part and a lower part, the upper part comprising an insecticidal net with a mesh size preventing selected insects, for example mosquitoes, to traverse the barrier, the lower part extending up to a height of more than 40 cm from the lower edge of the barrier, the lower part comprising an insecticidal material, said insecticidal material being selected from the group consisting of a tarpaulin, foil, woven fabric, knitted fabric, non-woven fabric, and net with a net material having a higher tear strength or bursting strength than the net of the upper part, or a combination of these, wherein either the upper part has a first content of insecticide and the lower part has a second content of insecticide, and wherein the second content of insecticide is higher than the first content, or the upper part has a first content of a first insecticide and the lower part has a second content of a second insecticide, the second insecticide being different from the first insecticide, wherein the second content multiplied by the ratio between the efficiency of the second insecticide and the efficiency of the first insecticide is higher than the first content.

2. An insecticidal barrier according to claim 1, wherein the second insecticide has a higher insecticidal efficiency than the first insecticide.

3. An insecticidal barrier according to claim 2, wherein the higher insecticidal efficiency is balanced by a lower content of the second insecticide in the lower part relative to the content of the first insecticide in the upper part.

4. An insecticidal barrier according to claim 1, wherein the lower part contains a second insecticide being different from a first insecticide of the upper part, the lower part being configured to maintain the lifetime as long as the upper part by balancing the dosage and the wash resistance.

5. An insecticidal barrier according to claim 1, wherein the lower part of the barrier extends up to a height of less than 100 cm from the lower edge of the net.

6. An insecticidal barrier according to claim 5, wherein the lower part of the barrier extends up to a height of less than 80 cm from the lower edge of the barrier.

7. An insecticidal barrier according to claim 6, wherein the lower part of the barrier extends to a height from the lower part of the barrier, the height being more than 60 cm from the lower edge of the barrier.

8. An insecticidal barrier according to claim 1, wherein the lower part of the barrier comprises a fabric.

9. An insecticidal barrier according to claim 8, wherein the lower part of the barrier is a skirt extending to the lower edge of the barrier.

10. An insecticidal barrier according to claim 8, wherein the lower part comprises a skirt of a first material and an intermediate part between the upper part and the skirt, the intermediate part being made of a second material, the second material being a fabric.

11. An insecticidal barrier according to claim 10, wherein the first material is a tarpaulin or foil.

12. An insecticidal barrier according to claim 10, wherein the area of the intermediate part between the skirt and the upper part is larger than the area of the skirt.

13. An insecticidal barrier according to claim 12, wherein the lower part of the barrier is a skirt extending to the lower edge of the barrier.

14. An insecticidal barrier according to claim 13, wherein the area of the intermediate part between the skirt and the upper part is larger than the area of the skirt.

15. An insecticidal barrier according to claim 12, wherein the lower part comprises a skirt of a first material and a intermediate part between the skirt and the upper part of a second material, the second material being a tarpaulin or a foil.

16. An insecticidal barrier according to claim 1, wherein the lower part of the barrier comprises a tarpaulin or foil.

17. An insecticidal barrier according to claim 16, wherein the tarpaulin or foil comprises a laminate with an inner reservoir of insecticide sandwiched between outer wall elements, wherein the insecticide is migratable through at least one of the outer wall elements in order to reach the outer surface of the tarpaulin or foil.

18. An insecticidal barrier according to claim 1, wherein the lower part of the barrier comprises an insecticidal net with a higher mesh density or yarn density or both than the insecticidal net in the upper part.

19. An insecticidal barrier according to claim 18, wherein the lower part comprises a skirt made of a tarpaulin, fabric or foil.

20. An insecticidal barrier according to claim 1, wherein insecticide or synergist or both are incorporated only into the material of the lower part of the barrier for gradual migration of the insecticide or synergist or both from inside the material to the surface of the material.

21. An insecticidal barrier according to claim 1, wherein only the lower part is provided by a polymer matrix into which insecticide or synergist or both are impregnated into a substantial depth from the surface of the matrix for gradual migration from the inside of the matrix to the surface of the material.

22. An insecticidal barrier according to claim 1, wherein insecticide or synergist or both are incorporated only into the material of the lower part of the barrier for gradual migration of the insecticide or synergist or both from inside the material to the surface of the material.

23. An insecticidal barrier according to claim 1, wherein only the upper part is provided by a polymer matrix into which insecticide or synergist or both are impregnated into a substantial depth from the surface of the matrix for gradual migration from the inside of the matrix to the surface of the material.

24. An insecticidal barrier according to claim 1, wherein the barrier has a canopy-like shape to cover a space around a bed or other space for human accommodation for keeping insects out of the space.

25. An insecticidal barrier according to claim 1, wherein the upper part is constructed of a first polymer and the lower part is constructed of a second polymer different from the first polymer.

26. An insecticidal barrier according to claim 1, wherein the surface of the upper part or the lower part or both are coated with a film containing at least one insecticide, the film being open for migration of a synergist through the film.

27. An insecticidal barrier according to claim 26, wherein the film comprises a film forming component reducing wash off and degradation of the insecticide from the netting or fabric by forming a water and optionally oil resistant film, the film being a molecular shield on or around the matrix integrating the insecticide in the film, wherein the film forming component comprises a polymeric backbone fixative and one or more components selected from paraffin oils or waxes, silicons, silicon oils or waxes, and polyfluorocarbons, or derivatives thereof.

28. An insecticidal barrier according to claim 27, wherein the film forming component comprises polyflurocarbon attached to the polymeric backbone.

29. An insecticidal barrier according to claim 1, wherein the insecticidal barrier is a canopy net with a net roof, the roof being made of polyester, and wherein the canopy net comprises side walls with an insecticidal net made of polyethylene.

* * * * *

UNITED STATES PATENT AND TRADEMARK OFFICE

CERTIFICATE OF CORRECTION

PATENT NO. : 8,061,377 B2
APPLICATION NO. : 12/452377
DATED : November 22, 2011
INVENTOR(S) : Mikkel Vestergaard Frandsen It is certified that error appears in the above-identified patent and that said Letters Patent is hereby corrected as shown below:

In the claims:

Column 13, line 26, change “12” to --16--.

Column 13, line 29, change “13” to --15--.

Column 13, line 32, change “12” to --16--.

Signed and Sealed this
Twenty-first Day of February, 2012

David J. Kappos

David J. Kappos
*Director of the United States Patent and Trademark Office*